US007413097B1

(12) United States Patent
Adams

(10) Patent No.: US 7,413,097 B1
(45) Date of Patent: Aug. 19, 2008

(54) TAMPER-EVIDENT CLOSURE AND METHOD OF MAKING SAME

(75) Inventor: Brian M. Adams, Newark, CA (US)

(73) Assignee: Portola Packaging, Inc., Batavia, IL (US)

( * ) Notice: Subject to any disclaimer, the term of this patent is extended or adjusted under 35 U.S.C. 154(b) by 762 days.

(21) Appl. No.: 10/901,759

(22) Filed: Jul. 28, 2004

Related U.S. Application Data

(60) Provisional application No. 60/491,950, filed on Aug. 1, 2003.

(51) Int. Cl.
*B65D 17/32* (2006.01)
*B65D 41/34* (2006.01)
*B65D 41/62* (2006.01)

(52) U.S. Cl. ..... 220/268; 215/43; 215/44; 215/252; 215/251; 215/258; 229/125.04; 229/125.05; 229/125.14

(58) Field of Classification Search ..... 215/252, 215/253, 258, 43, 44, 251; 220/270, 276, 220/268, 269, 258.2, 258.3; 229/125.04, 229/125.05, 125.14
See application file for complete search history.

(56) References Cited

U.S. PATENT DOCUMENTS

| | | | |
|---|---|---|---|
| 2,971,671 | A | 2/1961 | Shakman |
| 3,057,537 | A | 10/1962 | Pollick |
| 3,223,269 | A | 12/1965 | Williams |
| 3,458,080 | A | 7/1969 | Laurizio |
| 3,814,277 | A | 6/1974 | La Croce et al. |
| 3,990,603 | A | 11/1976 | Brochman |
| 4,200,196 | A | 4/1980 | Bashour |
| 4,356,939 | A | 11/1982 | Fitte |
| 4,380,303 | A | 4/1983 | Allen et al. |
| 4,391,385 | A | 7/1983 | Rausing |
| 4,393,979 | A | 7/1983 | Ball et al. |
| 4,408,697 | A | 10/1983 | Yoshikawa et al. |
| 4,453,646 | A | 6/1984 | Harrild |
| 4,461,391 | A | 7/1984 | Davis |
| 4,511,053 | A | 4/1985 | Brandes et al. |
| 4,513,876 | A | 4/1985 | Buchner |
| 4,540,102 | A | 9/1985 | Wiedmer |

(Continued)

FOREIGN PATENT DOCUMENTS

| | | |
|---|---|---|
| CA | 685952 | 5/1964 |

(Continued)

*Primary Examiner*—Anthony D Stashick
*Assistant Examiner*—Niki M. Eloshway
(74) *Attorney, Agent, or Firm*—James P. Hanrath; Adam K. Sacharoff

(57) ABSTRACT

A tamper-evident closure including a spout and a cap. The spout includes an upwardly extending neck defining a neck opening, an annular cap-engaging retainer extending radially outwardly from the neck, and a fulcrum interconnecting the cap-engaging retainer and the neck. The cap selectively seals the neck opening and includes a top, an annular skirt depending from the top, and a tamper-evidencing band frangibly connected to a lower end of the annular skirt. The tamper-evidencing band has a radially inwardly extending spout-engaging retainer. The cap-engaging retainer is adapted to engage the spout-engaging retainer when the cap is removed from the neck to limit upward movement of the tamper-evidencing band with respect to the neck. A method of using the tamper-evident closure is also disclosed.

21 Claims, 3 Drawing Sheets

U.S. PATENT DOCUMENTS 4,573,601 A 3/1986 Berglund
4,625,875 A 12/1986 Carr et al.
4,664,278 A 5/1987 Barriac
4,669,640 A 6/1987 Ando et al.
4,682,702 A 7/1987 Gach
4,708,255 A 11/1987 Thompson
4,732,289 A 3/1988 Granat et al.
4,746,025 A 5/1988 Krautkramer et al.
4,757,911 A 7/1988 Larkin et al.
4,770,325 A 9/1988 Gordon et al.
4,801,031 A 1/1989 Barriac
4,801,037 A 1/1989 Hayashida et al.
4,807,769 A 2/1989 Gach
4,813,561 A * 3/1989 Ochs ..... 215/252
4,828,127 A 5/1989 Young et al.
4,838,450 A 6/1989 Bocchi
4,850,503 A 7/1989 Larsson
4,858,776 A 8/1989 Mehra
4,875,594 A 10/1989 Ochs
4,887,765 A 12/1989 Rausing
4,948,003 A 8/1990 Munoz
4,964,562 A 10/1990 Gordon
4,978,016 A 12/1990 Hayes
4,981,230 A 1/1991 Marshall et al.
5,058,360 A 10/1991 Yamazaki et al.
5,069,372 A 12/1991 Kawajiri
5,076,453 A 12/1991 Odet
5,078,290 A 1/1992 Ochs
5,105,960 A 4/1992 Crisci et al.
5,105,961 A 4/1992 Noren et al.
5,125,886 A 6/1992 Dirksing
5,133,486 A 7/1992 Moore et al.
5,176,300 A 1/1993 Kishikawa et al.
5,176,313 A 1/1993 Curry et al.
5,190,178 A 3/1993 Luch
5,249,695 A 10/1993 Luch et al.
5,267,934 A 12/1993 Pape et al.
5,272,855 A 12/1993 Togi et al.
5,285,912 A 2/1994 Molinaro
5,297,688 A 3/1994 Beck et al.
5,301,849 A 4/1994 Guglielmini et al.
5,303,838 A 4/1994 Luch et al.
5,307,945 A 5/1994 Hidding et al.
5,307,946 A 5/1994 Molinaro
5,346,082 A 9/1994 Ochs et al.
5,366,433 A 11/1994 McCormick
5,400,913 A 3/1995 Kelly
5,415,306 A 5/1995 Luch et al.
5,435,803 A 7/1995 Owen et al.
5,456,376 A 10/1995 Luch et al.
5,465,876 A 11/1995 Crisci
5,480,045 A 1/1996 Molinaro et al.
5,484,374 A 1/1996 Bachner et al.
5,498,225 A 3/1996 Nedstedt
5,533,633 A 7/1996 King
5,540,342 A * 7/1996 Rathbun ..... 215/225
5,570,798 A 11/1996 Hayashida et al.
5,597,082 A 1/1997 Luch et al.
5,601,669 A 2/1997 Moody et al.
5,609,262 A 3/1997 Trout
5,653,832 A 8/1997 Thompson et al.
5,660,288 A 8/1997 Nyman, Jr.
5,685,443 A 11/1997 Taber et al.
5,727,705 A 3/1998 Kelly
5,735,426 A 4/1998 Babcock et al.
5,749,484 A 5/1998 Trout
5,759,143 A 6/1998 Blain et al.
5,759,319 A 6/1998 Moody et al.
5,765,747 A 6/1998 Lawson
5,770,009 A 6/1998 Blain et al.
5,775,527 A 7/1998 Bosl et al.
5,810,184 A 9/1998 Adams et al.
6,015,054 A 1/2000 King et al.
6,086,523 A 7/2000 Adams et al.
6,112,923 A * 9/2000 Ma ..... 215/252
6,116,442 A 9/2000 Higgins
6,119,883 A 9/2000 Hock et al.
6,129,228 A 10/2000 Adams et al.
6,152,316 A 11/2000 Niese
6,223,919 B1 * 5/2001 Kuehn ..... 215/252
6,231,491 B1 5/2001 Adams et al.
6,276,543 B1 8/2001 German et al.
6,575,319 B2 * 6/2003 Zumbuhl ..... 215/252
6,581,792 B1 * 6/2003 Limanjaya ..... 215/252
7,077,278 B2 * 7/2006 Dubach ..... 215/252
2001/0002661 A1 * 6/2001 Reidenbach ..... 215/252
2002/0125202 A1 * 9/2002 Ekkert ..... 215/44
2005/0161425 A1 * 7/2005 Morini ..... 215/204
2005/0252878 A1 * 11/2005 Babcock ..... 215/252

FOREIGN PATENT DOCUMENTS

DE 39 12 137 A1 10/1990
EP 0 620 152 B1 4/1997
FR 1523236 5/1968
FR 2 645 503 A1 10/1990
GB 2 238 287 A 5/1991
GB 2 276 370 9/1994

* cited by examiner

TAMPER-EVIDENT CLOSURE AND METHOD OF MAKING SAME

CROSS-REFERENCES TO RELATED APPLICATIONS

This application claims priority to U.S. Provisional Patent Application No. 60/491,950, filed Aug. 1, 2003 and entitled TAMPER EVIDENT CLOSURE AND METHOD OF MAKING SAME, the entire contents of which is incorporated herein by this reference.

BACKGROUND OF THE INVENTION

1. Field of the Invention

The present invention relates to a new and improved tamper-evident closure and method of making the same. In particular, the present invention relates to a spout having a tamper-evident ring for engaging a cap and methods for their use.

2. Description of Related Art

Containers used for dispensing beverages often include a fitment to provide both a tamper-evident and resealable closure. For example, containers having fitments are often used for distributing and dispensing juice, milk and other beverages. A fitment generally includes a spout which is attached to the container and a resealable cap which is selectively engagable with the spout.

An exemplar of a conventional container having a fitment is U.S. Pat. No. 5,133,486 to Moore et al. which shows a container having a tamper-evident pull ring pour spout. U.S. Pat. No. 5,176,300 to Kishikawa et al. shows a pouring plug for a liquid paper-container. Although the pour spout disclosed by the Moore patent includes a pull ring and the pouring plug disclosed by the Kishikawa patent discloses a lid having a pull ring, neither patents discloses a tamper-evidencing device capable of indicating that the cap has been removed from the pour spout or the pouring plug, respectively.

What is needed is a new and improved tamper-evident closure which overcomes the above and other disadvantages of known fitments.

BRIEF SUMMARY OF THE INVENTION

In summary, one aspect of the present invention is directed to a tamper-evident closure including a spout and a cap. The spout includes an upwardly extending neck defining a neck opening, an annular cap-engaging retainer extending radially outwardly from the neck, and a fulcrum interconnecting the cap-engaging retainer and the neck. The cap selectively seals the neck opening and includes a top, an annular skirt depending from the top, and a tamper-evidencing band frangibly connected to a lower end of the annular skirt. The tamper-evidencing band has a radially inwardly extending spout-engaging retainer. The cap-engaging retainer is adapted to engage the spout-engaging retainer when the cap is removed from the neck to limit upward movement of the tamper-evidencing band with respect to the neck.

Preferably, the closure is a fitment and the spout further includes an annular flange adapted for attachment to a container.

Preferably, the cap-engaging retainer includes an annular retaining ring extending radially outwardly from the neck. In one embodiment, the retaining ring is segmented. Preferably, the cap-engaging retainer is moveable between a first upwardly or horizontally extending molded position and a second downwardly extending capped position.

In one embodiment, the spout further includes an upper neck wall, a lower neck wall, and a frangible membrane sealing off the neck opening. Preferably, the frangible membrane is interconnected to an inner wall surface of the neck intermediate the upper neck wall and the lower neck wall. In one embodiment, the cap-engaging retainer extends outwardly from the neck intermediate the upper neck wall and the lower neck wall.

Preferably, the closure includes external thread on the neck and internal thread on the annular skirt. The external and internal thread cooperatively engage for removable engagement of the cap on the neck. Preferably, the cap-engaging retainer extends outwardly from the neck below the external thread.

Preferably, the fulcrum is formed by an annular groove in an upper surface of the cap-engaging retainer. Preferably, the annular groove is located proximal the neck.

In one embodiment, a plurality of frangible bridges interconnect the tamper-evidencing band and the lower end of the annular skirt.

In one embodiment, the spout-engaging retainer comprises an annular retaining rim extending inwardly from the tamper-evidencing band.

Another aspect of the present invention is directed to a combination including a tamper-evident cap and a container. The container includes an upwardly extending neck defining a neck opening, an annular cap-engaging retainer extending radially outwardly from the neck, and a fulcrum interconnecting the cap-engaging retainer and the neck. The cap selectively seals the neck opening. The cap includes a top, an annular skirt depending from the top, and a tamper-evidencing band frangibly connected to a lower end of the annular skirt. The tamper-evidencing band has a radially inwardly extending container-engaging retainer. The cap-engaging retainer is adapted to engage the container-engaging retainer when the cap is removed from the neck to limit upward movement of the tamper-evidencing band with respect to the neck.

Preferably, the cap-engaging retainer includes an annular retaining ring extending radially outwardly from the neck. In one embodiment, the retaining ring is segmented. Preferably, the cap-engaging retainer is moveable between a first upwardly or horizontally extending molded position and a second downwardly extending capped position.

In one embodiment, the combination includes external thread on the neck and internal thread on the annular skirt. The external and internal thread cooperatively engage for removable engagement of the cap on the neck. Preferably, the cap-engaging retainer extends outwardly from the neck below the external thread.

Preferably, the fulcrum is formed by an annular groove in an upper surface of the cap-engaging retainer An object of the present invention is to provide an improved closure having a spout, a cap, and a tamper-evidencing device to indicate that the cap has been removed from the spout.

The tamper-evident closure and method of making same of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
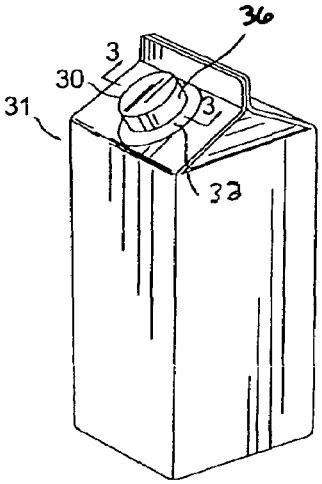
FIG. 1 is a perspective view of a tamper-evident closure in accordance with the present invention mounted on a container.

Turning now to the drawings, wherein like components are designated by like reference numerals throughout the various figures, attention is directed to FIG. 1 which illustrates a closure 30 mounted upon a container 31 in accordance with the present invention. In some aspects, the closure of the present invention is similar to the fitments disclosed by U.S. Pat. No. 6,231,491 to Adams et al. and to the fitments disclosed by U.S. Pat. No. 6,129,228 also to Adams et al., the entire contents of which patents are incorporated herein by this reference.

Container 31 is a conventional paperboard carton of the type commonly used for distributing and dispensing granular substances and/or liquids, including juice, milk and other beverages. The illustrated closure is a fitment 30 and includes a spout 32 which is attached to container in a known manner, and a resealable cap 36 which is selectively engagable with spout 32. Although the fitment of the present invention is illustrated in combination with a paperboard carton, one should appreciate that the fitment in accordance with the present invention is equally suited for use with other types of containers including beverage bags, sacks, and other flexible packaging. Furthermore, the tamper-evident band described herein is equally suited for use with other types of containers and closures therefore including, but not limited to, rigid containers.

The spout and the cap of the closure are formed with materials that have a certain degree of flexibility or "give" as discussed below. For example, the spout may be formed of low density polyethylene, linear low-density polyethylene, high-density polyethylene, polypropylene, and other suitable materials, and the closure may be formed of low density polyethylene, high density polyethylene, polypropylene, polystyrene, and other suitable materials.

Figure 3:
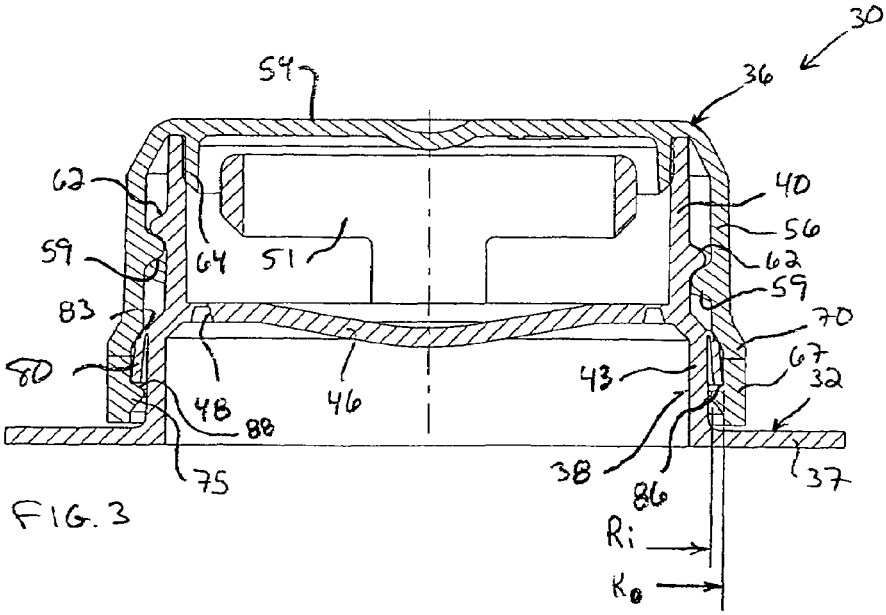
FIG. 3 is a cross-sectional side view of the cap and spout shown in FIG. 2 taken along line 3-3 in FIG. 1.

Referring to FIG. 3, spout 32 includes an annular spout flange 37 and a cylindrical neck 38 extending upward therefrom. One should appreciate that the terms "upward" and "downward" as well as "inward" and "outward" are not intended to denote vertical or horizontal directions and are merely provided for clarity with reference to the drawings. Spout flange 37 is attached to container 31 adjacent a dispensing hole (not shown) thereof by ultrasonically welding, adhesives, or other suitable means.

As shown in FIG. 3, spout neck 38 includes an upper wall portion 40 and a lower wall portion 43 having inner wall surfaces that, together with the container dispensing hole, form an opening which allows dispensing of the contents of container 31.

With continued reference to FIG. 3, spout 32 preferably includes a tamper-indicating membrane 46 which seals the opening of spout 32 until a consumer initially opens the container. A line of weakness 48 frangibly connects an outer periphery of membrane 46 to the inner wall surface of spout neck 38. In the illustrated embodiment, the line of weakness or tear line 48 is formed by a groove that extends around an underside of membrane 46 adjacent the intersection of the membrane and the spout neck intermediate upper wall portion 40 and lower wall portion 43. One should appreciate that the tear line may have other configurations, for example, a groove in the topside of the membrane. A pull ring 51 is connected to membrane 46 in a well-known manner allowing a consumer to grip and tear membrane 46 from spout 32 and thus access the contents of the container.

One should appreciate that the tamper-indicating membrane may be located at a bottom edge of the spout or at any desired location above the bottom edge. Alternatively, the tamper-indicating membrane may be in the form of a foil membrane attached to an upper edge of the spout. One should appreciate that a spout without a tamper-evident membrane also falls within the scope of the present invention.

Cap 36 includes a substantially flat, round top 54 and an annular skirt 56 extending downwardly from a periphery of the top. Annular skirt 56 includes a spout-engaging member 59 that cooperates with a cap-engaging member 62 located on the upper wall portion 40 of spout neck 38. Preferably, the spout-engaging member includes an internal spout-engaging thread 58 provided on an internal surface of annular cap skirt 56 and the cap-engaging member includes an external cap-engaging thread 62 provided on upper wall portion 40 of spout neck 38. In the illustrated embodiment, a plurality of internal threads 58 cooperate with external threads 62 to selectively disengage and reengage cap 36 and spout 32. In particular, cap 36 is removed from spout 32 by twisting cap 36 in one direction relative to container 31 and spout 32 and unthreading closure from spout 32. Cap 36 is reengaged with spout 32 by twisting cap 36 in the opposite direction relative to spout 32 and rethreading cap 36 onto spout 32. Thus, if the contents of the container are not completely dispensed, cap 36 can be used for reclosure purposes.

The cooperating internal and external threads may be in the form of multi-lead threads or a single lead thread extending partially or completely around the outer neck wall of the spout. The threads may be either continuous or segmented. One should also appreciate that other types of means engaging members may be used instead of threads in accordance with the present invention. For example, friction engaging surfaces and/or cooperatively engaging beads located on the cap and the spout may be used to releasably secure the cap to the spout Preferably, cap 36 includes a hollow annular sealing plug 64 depending downwardly from an inner surface of cap top 54 as shown in FIG. 3. One should appreciate that the plug may be provided in the form of a solid disk projecting from the inner surface of top as well as other suitable forms. Alternatively, one should appreciate that a cap without a plug also falls within the scope of the present invention. In the event that the closure is not provided with a plug, a liner of compressible material may be provided to seal the inner surface of the closure against a top edge of the spout.

Figure 2:
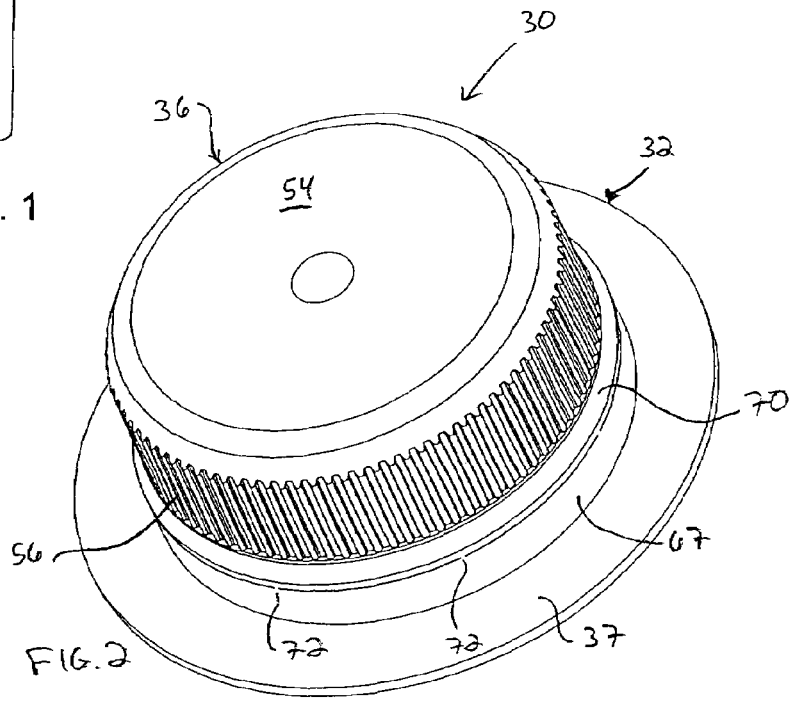
FIG. 2 is an enlarged perspective view of the tamper-evident closure of FIG. 1 having a cap and a spout.

As shown in FIG. 2, cap 36 includes a tamper-evidencing band 67 that is frangibly connected to a lower end 70 of annular cap skirt 56 in a well-known manner. Preferably, tamper-evidencing band 67 is connected by a plurality of circumferentially spaced frangible bridges 72 that are designed and configured separate when cap 36 is removed from spout 32, as discussed below. Frangible bridges 72 have sufficient compressive rigidity to withstand the compressive forces imposed upon application of cap 36 onto spout 32, yet also have minimal tensile strength so that frangible bridges 72 break when the cap is unscrewed from the spout. Tamper-evidencing band 67 includes a inward radially projecting retaining bead 75 that is designed and configured to interfere with a portion of spout 32 when cap 36 is unscrewed from the spout in order to limit upward motion of band 67 relative to the spout and to break frangible bridges 72 as the cap is unscrewed from the spout. Such a frangible configuration of the bridges provides visible evidence in the form of broken bridges which indicate that cap 36 has been partially and/or fully unscrewed from spout 32.

In accordance with the present invention, spout 32 includes a tamper-evidencing ring or retaining ring 80 that cooperates with tamper-evidencing band 67 of cap 36 in order to provide the visible evidence that the closure may have been tampered with. In particular, retaining bead 75 interferes with retaining ring 80 as cap 36 is unscrewed from spout 32 such that upward movement of tamper-evidencing band 67 is limited and thus causes breakage of frangible bridges 72 and, in the event that the cap is removed from the spout, causes band 67 to remain with spout 32 when the cap is removed from the spout.

Figure 5:
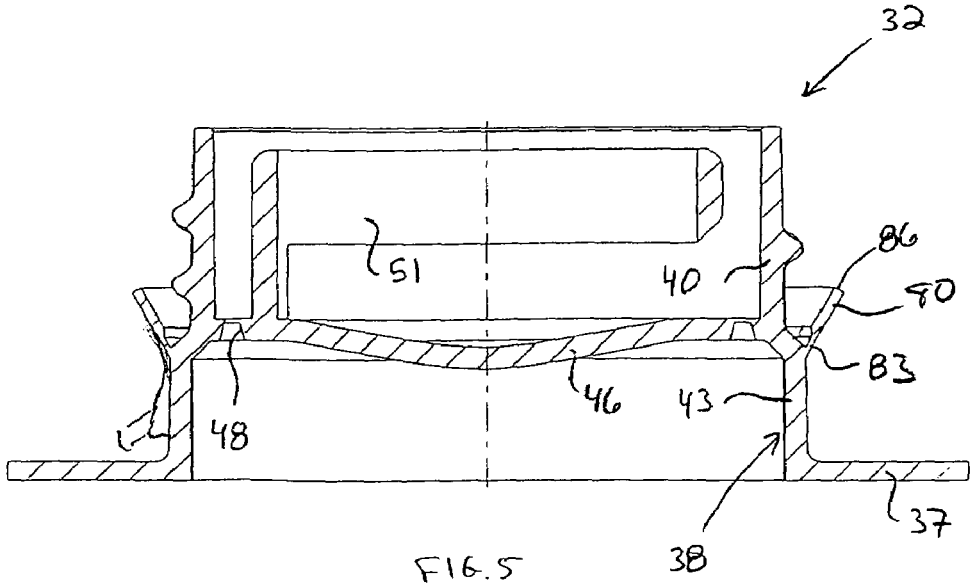
FIG. 5 is a cross-sectional side view of the spout shown in FIG. 2 prior to application of the cap thereto.

As most clearly shown in FIG. 5, retaining ring 80 projects radially outward from spout neck 38. In the embodiment illustrated in FIGS. 3 and 5, retaining ring 80 is connected to spout neck 38 along a circumferential hinge or fulcrum 83 that extends along an upper outer periphery of lower wall portion 43 of the spout neck. One should appreciate, however, the retaining ring may be attached to either the upper wall portion and/or the lower wall portions of the spout neck in accordance with the present invention.

Figure 4:
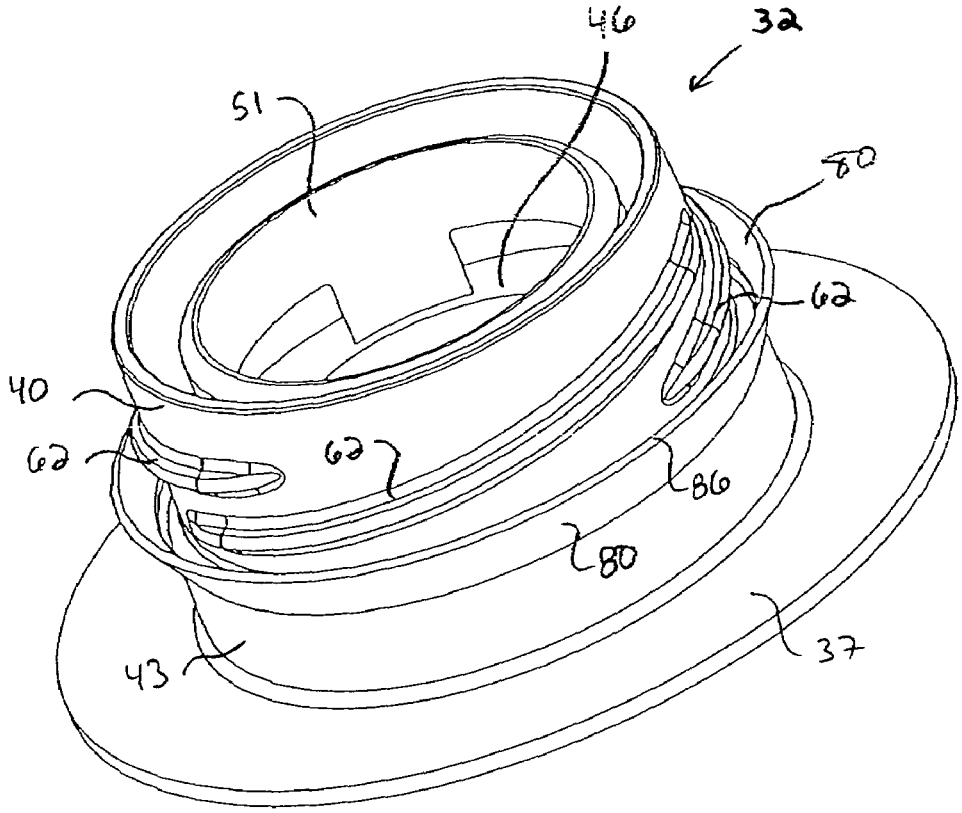
FIG. 4 is an enlarged perspective view of the spout shown in FIG. 2 prior to application of the cap thereto.

Preferably, the wall thickness of fulcrum 83 is thinner than the wall thickness of retaining ring 80 in order to allow the retaining ring to flex from its "molded" position shown in FIGS. 4 and 5 to its "capped" position shown in FIG. 3 as cap 36 is applied to spout 32. In the illustrated embodiment, retaining ring 80 initially extends upwardly in its "molded" position, however, one should appreciate that the retaining ring may be configured and designed to extend horizontally in its "molded" position.

Preferably, closure 30 is of the snap-on, screw-off variety which allows cap 36 to be applied to spout 32 with an downward axial force without externally imposed relative rotation between the cap and the spout in a well-known manner. As cap 36 is applied to spout 32, a bottom edge of tamper-evidencing band 67 contacts and pushes upper edge 86 of retaining ring 80 downwardly thus causing retaining ring 80 to flex from its "molded" position to its "capped" position.

As shown in FIG. 3, an outer edge 86 of retaining ring 80 has a radius of curvature that, when retaining ring is in its "capped" position, closely approximates the curvature of lower end 70 of annular skirt 56 and band 67. In particular, outer edge 86 includes an outer radius $R_o$ that is larger than an inner radius $R_i$ of retaining bead 75 to ensure that a portion of tamper-evidencing band 67 interferes with and abuts against a portion of spout neck 38 as cap 36 is unscrewed from spout 32 in order to cause breakage of frangible bridges 72.

With reference to FIG. 3, retaining ring 80 extends outwardly and downwardly in its "capped" position so that lower free edge 86 faces downwardly and is positioned to engage an upper surface 88 of retaining bead 75 as cap 36 is unscrewed from spout 32.

The method of using the tamper-evidencing closure of the present invention can now be described. In operation and use, a consumer or other end user whom wishes to access the contents of container 31 will grip cap 36 and unscrew the cap from spout 32 in a well known manner. As cap 36 is unscrewed from spout 32, retaining bead 75 of the cap abuts against outer edge 86 of retaining ring 80 thus limiting upward movement of tamper-evidencing band 67 with respect to spout 36. Continued unscrewing by the consumer imparts sufficient tensile force on frangible bridges 72 causing the bridges to break. The broken bridges provide visible indication that cap 36 was at least partially unscrewed from spout thus providing evidence that the contents of container 31 and/or the frangible membrane 46 of spout 32 may have been tampered with.

Advantageously, the design and configuration of retaining ring 80 provides a closure that is more difficult to tamper with. Theoretically, it is possible to pry a tamper-indicating band of a conventional closure out beyond a locking surface of the respective container to which the closure is applied with the use of a flat edge tool such as a standard screw driver. In contrast to prior conventional designs having a rigid locking surface on the neck of the container, the present invention includes a flexible retaining ring 80 mounted on the container neck, that is, the spout neck that engages retaining bead 75 across at least a majority of the outer free edge 86 of retaining ring 80. Thus it is more difficult for one to pry enough of retaining bead 75 outwardly enough to slip over retaining ring 80 because the retaining ring flexes and remains in contact with the retaining bead.

Advantageously, retaining ring 80 is located internally of cap 36 such that it is not outwardly visible. Accordingly, it is more difficult for someone with malicious intent to tamper with closure 30 as it is more difficult for an individual to tamper with a retaining ring which cannot be seen much less for an individual to determine whether the closure has a retaining ring instead of a conventional locking surface.

Advantageously, the configuration of the retaining ring allows production with relatively large manufacturing tolerances between the dimensions of the cap and the spout.

Figure 6:
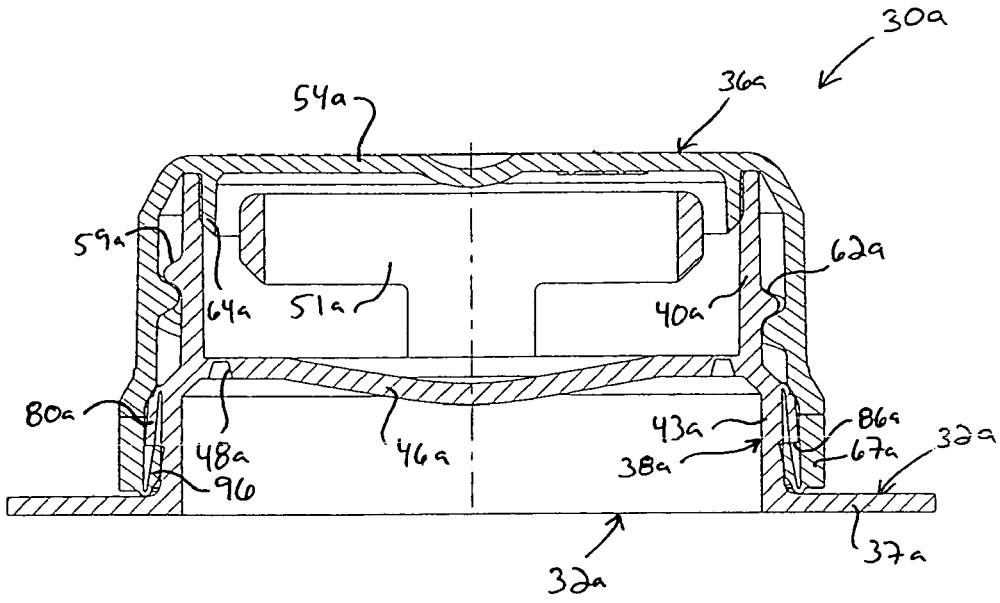
FIG. 6 is a cross-sectional side view of another tamper-evident closure in accordance with the present invention similar to that shown in FIG. 1 and having a modified cap and a modified spout.
Figure 7:
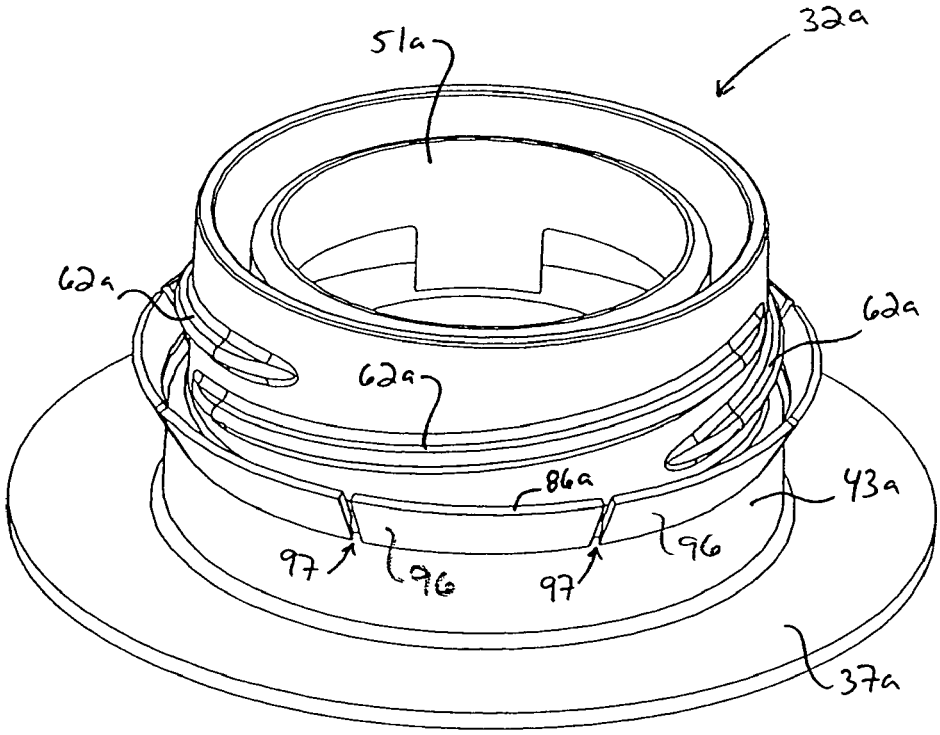
FIG. 7 is a perspective view of the spout shown in FIG. 6 prior to application of the cap thereto.

In another embodiment of the present invention, closure **30*a* is similar to closure 30 described above but includes a modified retaining ring 80*a* as shown in FIGS. 6 and 7. Like reference numerals have been used to describe like components of closures 30 and 30*a***.

In this embodiment, retaining ring **80*a* is segmented and includes a plurality of arcuate portions 96. In the illustrated embodiment, retaining ring 80*a*** includes eight arcuate portions, however, one should appreciate that two, three, four or more arcuate portions may be utilized in accordance with the present invention.

The segmented configuration of retaining ring **80*a* provides additional flexibility of the retaining ring which may facilitate application of cap 36*a* to spout 32*a* and/or further prevent someone from prying the tamper-evidencing band over the retaining ring. Additionally, gaps 97 formed between adjacent arcuate portions 96 facilitate drainage. In particular, gaps 97 formed in retaining ring 80*a* extend inwardly proximal, and preferably into, fulcrum 83*a*** and will permit any liquids which may accumulate during the filling and capping process to drain out from the spout or at least evaporate more readily so that they do not provide a habitat for mold and bacteria growth.

Closure 30*a* includes a tamper-evidencing band 67*a* having an inwardly and upwardly turned retaining rim 94 instead of the retaining bead 75 described above. In many aspects, retaining rim 94 is similar to that retaining rim described in U.S. Pat. No. 6,112,923 to Ma, the entire contents of which patent is incorporated herein by this reference.

Retaining rim 94 includes an upper free edge 99 having a radius of curvature that approximates the curvature of an outer surface of spout neck 38*a* so that when cap 36*a* is mounted onto spout 32*a*, the upper edge 96 firmly grips outer edge 86*a* of retaining ring 80*a*. Accordingly, as cap 36*a* is unscrewed from spout 32*a*, the cooperation between upper edge 99 and outer edge 86*a* prevents upward movement of tamper-evidencing band 67*a* and thus causes the frangible bridges of cap 36*a* to break. Thus, in operation and use, closure 30*a* is used in substantially the same manner as closure 30 discussed above.

For convenience in explanation and accurate definition in the appended claims, the terms "up" or "upper", "down" or "lower", "inner" and "outer" are used to describe features of the present invention with reference to the positions of such features as displayed in the figures.

In many respects the modifications of the various figures resemble those of preceding modifications and the same reference numerals followed by subscript a designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A tamper-evident closure comprising:

a spout including an upwardly extending neck defining a neck opening, an annular cap-engaging retainer extending radially outwardly from said neck, and a fulcrum formed by a thinned section in a surface of said cap-engaging retainer interconnecting said cap-engaging retainer and said neck; and a cap for selectively sealing said neck opening, said cap including a top, an annular skirt depending from said top, and a tamper-evidencing band frangibly connected to a lower end of said annular skirt, said tamper-evidencing band having a radially inwardly extending spout-engaging retainer;

wherein said cap-engaging retainer is adapted to engage said spout-engaging retainer when said cap is removed from said neck to limit upward movement of said tamper-evidencing band with respect to said neck.

2. The tamper-evident closure of claim 1, wherein said closure is a fitment and said spout further comprises an annular flange adapted for attachment to a container.

3. The tamper-evident closure of claim 1, wherein said cap-engaging retainer comprises a flexible retaining ring extending radially outwardly from said neck.

4. The tamper-evident closure of claim 3, wherein said retaining ring is segmented.

5. The tamper-evident closure of claim 1, wherein said cap-engaging retainer is moveable between a first upwardly extending molded position and a second downwardly extending capped position.

6. The tamper-evident closure of claim 1, wherein said cap-engaging retainer is moveable between a first horizontally extending molded position and a second downwardly extending capped position.

7. The tamper-evident closure of claim 1, wherein said spout further comprises an upper neck wall, a lower neck wall, and a frangible membrane sealing off said neck opening, said frangible membrane interconnected to an inner wall surface of said neck intermediate said upper neck wall and said lower neck wall.

8. The tamper-evident closure of claim 7, wherein said cap-engaging retainer extends outwardly from said neck intermediate said upper neck wall and said lower neck wall.

9. The tamper-evident closure of claim 1, said closure further comprising external thread on said neck and internal thread on said annular skirt, said external and internal thread cooperatively engaging for removable engagement of said cap on said neck.

10. The tamper-evident closure of claim 8, wherein said cap-engaging retainer extends outwardly from said neck below said external thread.

11. The tamper-evident closure of claim 1, wherein said fulcrum has a wall thickness thinner than the wall thickness of said retaining ring.

12. The tamper-evident closure of claim 1, wherein said thinned section is located proximal said neck.

13. The tamper-evident closure of claim 1, further comprising a plurality of frangible bridges interconnecting said tamper-evidencing band and said lower end of said annular skirt.

14. The tamper-evident closure of claim 1, wherein said spout-engaging retainer comprises an annular retaining rim extending inwardly from said tamper-evidencing band.

15. In combination, a tamper-evident cap and a container, said combination comprising:

a container including an upwardly extending neck defining a neck opening, an annular cap-engaging retainer extending radially outwardly from said neck, and a fulcrum formed by a thinned section in a surface of said cap-engaging retainer interconnecting said cap-engaging retainer and said neck; and a cap for selectively sealing said neck opening, said cap including a top, an annular skirt depending from said top, and a tamper-evidencing band frangibly connected to a lower end of said annular skirt, said tamper-evidencing band having a radially inwardly extending container-engaging retainer;

wherein said cap-engaging retainer is adapted to engage said container-engaging retainer when said cap is removed from said neck to limit upward movement of said tamper-evidencing band with respect to said neck.

16. The combination of claim 15, wherein said cap-engaging retainer comprises an annular retaining ring extending radially outwardly from said neck.

17. The combination of claim 15, wherein said cap-engaging retainer is moveable between a first upwardly extending molded position and a second downwardly extending capped position.

18. The combination of claim 15, wherein said cap-engaging retainer is moveable between a first horizontally extending molded position and a second downwardly extending capped position.

19. The combination of claim 15, said closure further comprising external thread on said neck and internal thread on said annular skirt, said external and internal thread cooperatively engaging for removable engagement of said cap on said neck.

20. The combination of claim 19, wherein said cap-engaging retainer extends outwardly from said neck below said external thread.

21. The combination of claim 15, wherein said fulcrum has a wall thickness thinner than the wall thickness of said retaining ring.

* * * * *